US010377552B2

(12) United States Patent
Yamauchi

(10) Patent No.: US 10,377,552 B2
(45) Date of Patent: Aug. 13, 2019

(54) BOTTLE CAP

(71) Applicant: MegaHouse Corporation, Tokyo (JP)

(72) Inventor: Takahiro Yamauchi, Tokyo (JP)

(73) Assignee: MEGAHOUSE CORPORATION, Tokyo (JP)

( * ) Notice: Subject to any disclaimer, the term of this patent is extended or adjusted under 35 U.S.C. 154(b) by 248 days.

(21) Appl. No.: 15/513,022

(22) PCT Filed: Jan. 4, 2016

(86) PCT No.: PCT/JP2016/050018
§ 371 (c)(1),
(2) Date: Mar. 21, 2017

(87) PCT Pub. No.: WO2017/119052
PCT Pub. Date: Jul. 13, 2017

(65) Prior Publication Data

US 2018/0327170 A1 Nov. 15, 2018

(51) Int. Cl.
*B65D 81/36* (2006.01)
*A63H 33/08* (2006.01)
*B65D 41/04* (2006.01)

(52) U.S. Cl.
CPC ..... *B65D 81/361* (2013.01); *B65D 41/04* (2013.01); *B65D 41/0407* (2013.01);
(Continued)

(58) Field of Classification Search
USPC ..... 215/228
See application file for complete search history.

(56) References Cited

U.S. PATENT DOCUMENTS 4,560,077 A * 12/1985 Dutt ..... B65D 41/0421 215/307
5,795,210 A 8/1998 Kushner et al.
(Continued)

FOREIGN PATENT DOCUMENTS

CN 102985329 3/2013
CN 104918861 9/2015
(Continued)

OTHER PUBLICATIONS

International Search Report dated Apr. 5, 2016 in International (PCT) Application No. PCT/JP2016/050018.
(Continued)

*Primary Examiner* — James N Smalley
(74) *Attorney, Agent, or Firm* — Wenderoth, Lind & Ponack, L.L.P.

(57) ABSTRACT

A bottle cap capable of connection to another bottle cap stacked in an axial direction, and which can be detachably attached to a bottle mouth of a bottle, includes a top plate that covers an opening of the bottle mouth, a side wall of a hollow cylinder that vertically extends from a rim of the top plate and is screwed to the bottle mouth, an inner cylinder of a hollow cylinder that vertically extends in a space surrounded by the side wall from an inner surface of the top plate and forms an annular space with the side wall, and a plurality of cylindrical projections that project from an outer surface of the top plate and have a diameter having a same dimension as a width of the circular space in a radial direction. A projection position of the projections overlaps a set position of the annular space.

7 Claims, 12 Drawing Sheets

(52) U.S. Cl.
CPC ..... *B65D 81/36* (2013.01); *A63H 33/086* (2013.01); *B65D 2251/023* (2013.01); *B65D 2251/065* (2013.01)

(56) References Cited

U.S. PATENT DOCUMENTS

| | | | | |
|---|---|---|---|---|
| 2011/0139745 | A1 | 6/2011 | Ezra et al. | |
| 2013/0015185 | A1* | 1/2013 | Leal ..... | B65D 81/361 220/212 |
| 2013/0090033 | A1 | 4/2013 | Vollers et al. | |
| 2014/0073217 | A1* | 3/2014 | Shao ..... | B65D 81/361 446/77 |
| 2015/0336019 | A1 | 11/2015 | Vollers et al. | |

FOREIGN PATENT DOCUMENTS

| | | |
|---|---|---|
| EP | 2 578 510 | 4/2013 |
| EP | 2 939 945 | 11/2015 |
| JP | 2009-227314 | 10/2009 |
| JP | 2012-500757 | 1/2012 |
| JP | 3173483 | 1/2012 |
| JP | 2012-171665 | 9/2012 |
| WO | 2011/153598 | 12/2011 |

OTHER PUBLICATIONS

Extended European Search Report dated Oct. 9, 2017 in European Application No. 16845321.5.
Office Action dated Mar. 21, 2019 in Chinese Patent Application No. 201680002774.5, with English-language translation.

* cited by examiner

BOTTLE CAP

TECHNICAL FIELD

This invention relates to a bottle cap which seals, for example, a resin bottle for a beverage.

BACKGROUND ART

A bottle cap including a top plate part which covers an opening of a bottle mouth, a cylindrical side wall part which vertically extends from a rim part of the top plate part and is screwed to the bottle mouth, and a plurality of projection parts that projects outside from the top plate part has been conventionally known. In such a bottle cap, an interval dimension between the projection parts is almost the same as the thickness of the side wall part (see, JP2012-500757A, for example).

When a conventional bottle cap is stacked on another bottle cap in an axis direction, an open end part of the side wall part is held between the projection parts formed in the top plate part of another bottle cap. These bottle caps are thereby connected. To connect bottle caps in which the axis lines thereof are not aligned, many projection parts are required. In accordance with an increase in the number of projection parts, higher manufacturing accuracy is required. The interval dimension between the projection parts is also required to be almost the same as the thickness of the side wall part. When the interval between the projection parts is narrow, it is difficult to clean up, for example, dust adhered between the projections.

The present invention has been made in view of the above problems, and an object of the present invention is to provide a bottle cap capable of being connected to another bottle cap stacked in the axis direction with a simple configuration.

SUMMARY OF THE INVENTION

To achieve the above object, a bottle cap that is detachably attached to a bottle mouth of a bottle according to the present invention includes a top plate part that covers an opening of the bottle mouth, a side wall part of a hollow cylinder that vertically extends from a rim of the top plate part and is screwed to the bottle mouth, an inner cylinder part of a hollow cylinder that vertically extends, in a space surrounded by the side wall part, from an inner surface of the top plate part and forms a circular space with the side wall part, and a plurality of cylinder projection parts that project from an outer surface of the top plate part and have a diameter having a same dimension as a width of the circular space in a radial direction. The projection position of the projection part is overlapped with a set position of the circular space.

Advantageous Effects

In the bottle of the present invention, the width, in the radial direction, of the circular space formed between the side wall part that vertically extends from the top plate part and the inner cylinder part has the same dimension as the diameter of a plurality of projection parts that projects from the top plate part, and the projection position of the projection part is overlapped with the set position of the circular space. When the bottle caps are stacked in the axis direction, the projection parts of the lower bottle cap are inserted into the circular space of the upper bottle cap, and the projection parts of the lower bottle cap are held by the inner circumference surface of the side wall part and the outer circumference surface of the inner cylinder part of the upper bottle cap. The bottle caps are thereby connected. With this configuration, the number of projection parts is decreased and accuracy required for manufacturing the cap is lowered compared to a bottle cap in which an open end part of a side wall part of another bottle cap is inserted between projection parts projecting from a top plate part and the open end part of the side wall part of another bottle cap is held by the projection parts. The interval between the projection parts is set to be larger than the thickness of the side wall part. Thus, for example, dust hardly accumulates between the projection parts. That is, the bottle cap is capable of being connected to another bottle cap stacked in the axis direction with a simple configuration.

DETAILED DESCRIPTION OF THE INVENTION

Figure 1:
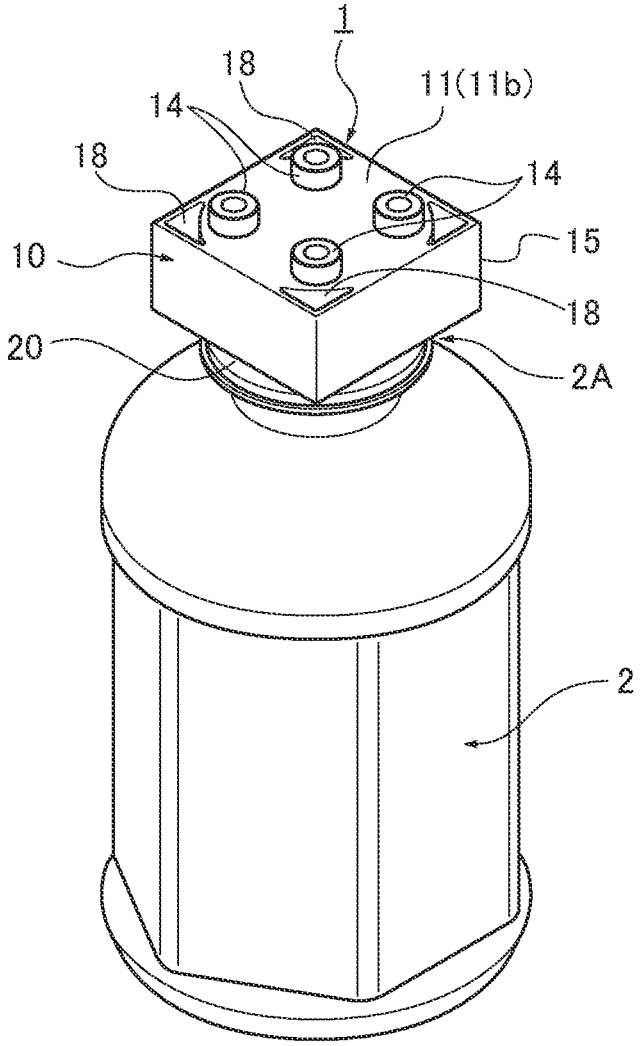
FIG. 1 is an entire perspective view illustrating a bottle to which a bottle cap of Embodiment 1 is attached.

Hereinafter, an embodiment of a bottle cap of the present invention will be described with reference to Embodiment 1 illustrated in the drawings.

Embodiment 1

Figure 2:
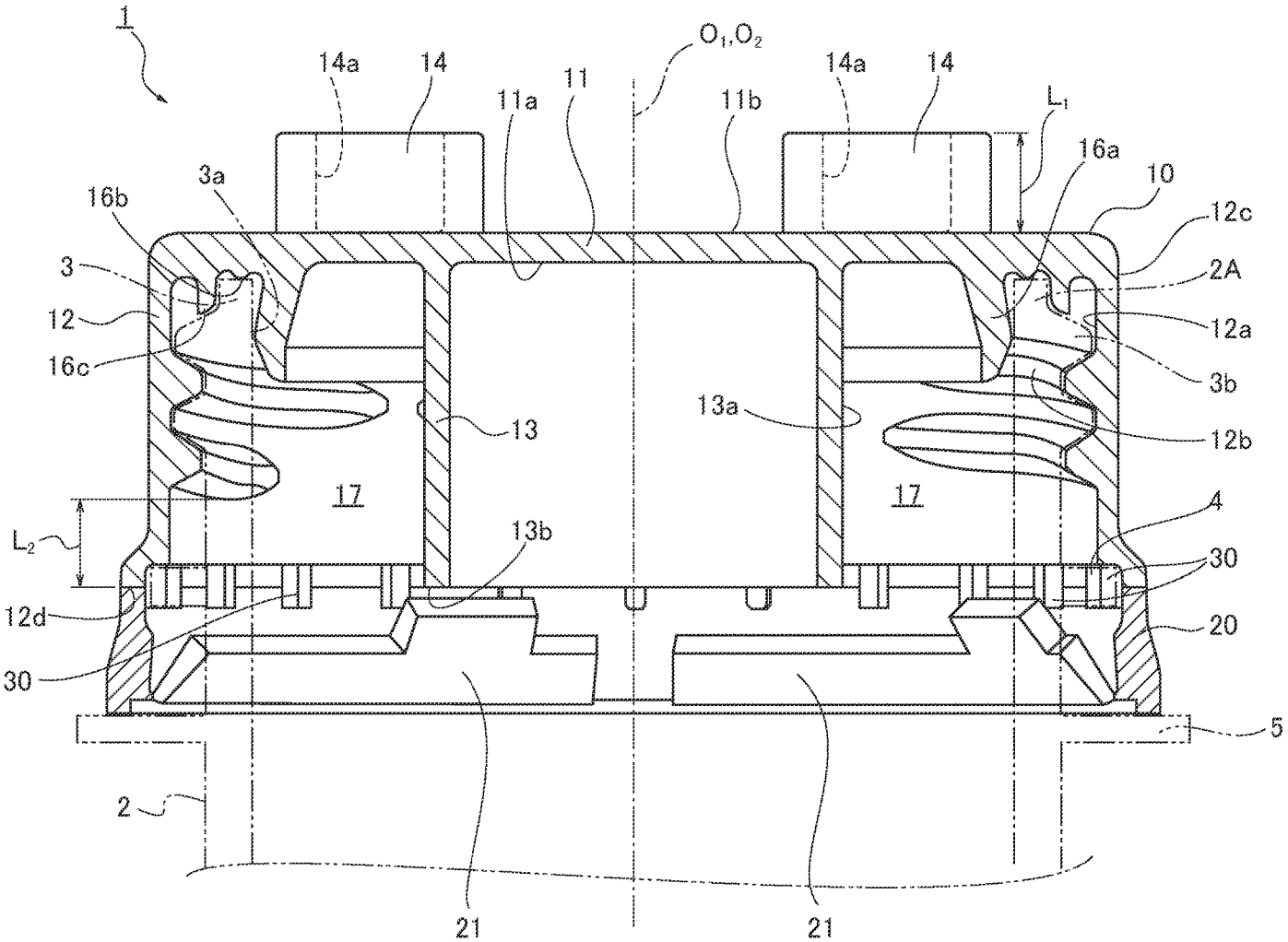
FIG. 2 is a vertical sectional view of the bottle cap of Embodiment 1.
Figure 3:
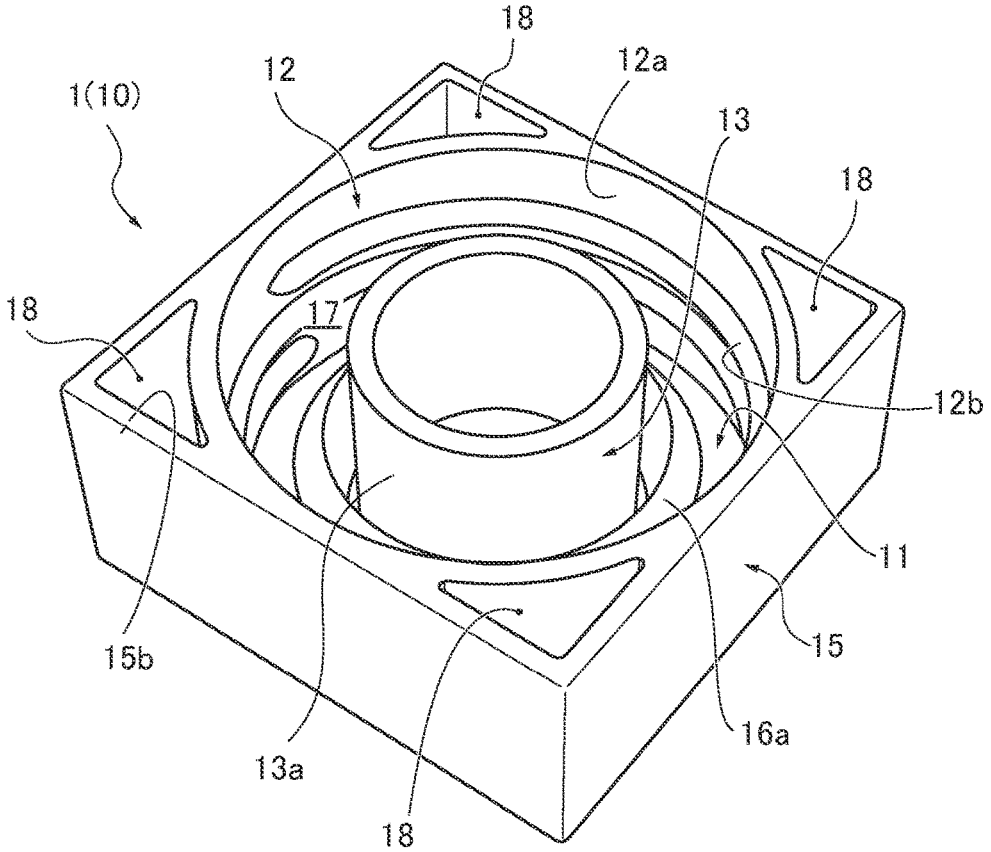
FIG. 3 is a perspective view illustrating an inside of the bottle cap of Embodiment 1.

FIG. 1 is an entire perspective view illustrating a bottle to which a bottle cap of Embodiment 1 is attached. FIG. 2 is a vertical sectional view of the bottle cap of Embodiment 1. FIG. 3 is a perspective view illustrating an inside of the cap.

Figure 4:
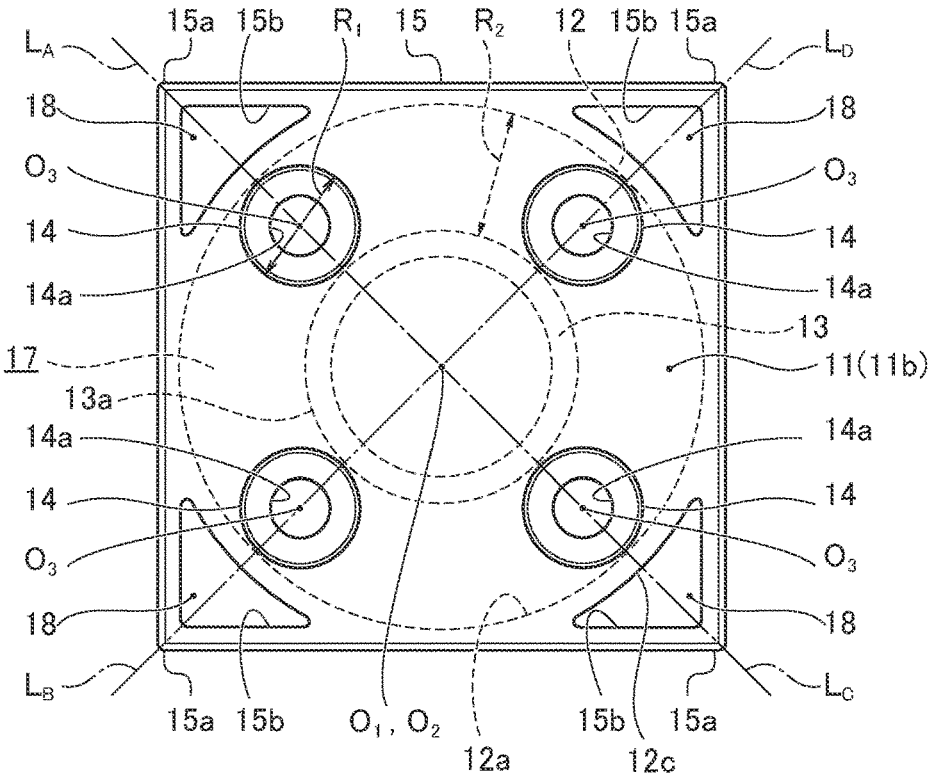
FIG. 4 is a plan view of the bottle cap of Embodiment 1.

FIG. 4 is a plan view. A configuration of the bottle cap in Embodiment 1 will be described with reference to FIGS. 1 to 4.

As illustrated in FIG. 1, a bottle cap 1 is detachably attached to a bottle mouth 2A of a bottle 2 such as a plastic bottle, and is integrally formed by polyethylene terephthalate, polypropylene, polystyrene resin, or the like with injection molding, for example.

The bottle cap 1 is formed into a tube shape having a closed top end. The bottle cap 1 includes in an upper portion thereof a cap main body 10, a tamper-evident band 20 connected to a lower end of the cap main body 10, and a fragile part 30 formed in a border of the cap main body 10 and the tamper-evident band 20. The bottle cap 1 is a one-piece cap without separate packing.

In addition, the bottle mouth 2A of the bottle 2 to which the bottle cap 1 is attached includes a cylindrical main body 3 having at a leading end thereof an opening 3*a* and on an outer circumference thereof a male screw (thread) part 3*b*, an upper flange part 4 formed below the male screw part 3*b*, and a lower flange part 5 formed below the upper flange part 4 (refer to FIG. 2).

The cap main body 10 includes a top plate part 11, a side wall part 12, an inner cylinder part 13, projection parts 14, and an external wall part 15.

The top plate part 11 is located on the top of the cap main body 10, and covers the opening 3*a* of the bottle mouth 2A. The top plate part 11 has a disc-like shape. An inner ring 16*a* that is inserted into the opening 3*a* of the bottle mouth 2A, and closely contacts an inside surface of the bottle mouth 2A, a contact ring 16*b* that is pressed to an end surface of the opening 3*a* of the bottle mouth 2A, and an auxiliary ring 16*c* that closely contacts an outside surface of the bottle mouth 2A are integrally formed in an inner surface 11*a* of the top plate part 11 which is a surface facing the bottle mouth 2A when the bottle cap 1 is attached to the bottle 2.

The side wall part 12 vertically extends from a rim of the top plate part 11, and is a hollow cylinder member having an open leading end. A female screw (thread) part 12*b* that is screwed to the male thread part 3*b* of the bottle mouth 2A is formed in an inner circumference surface 12*a* of the side wall part 12.

The inner cylinder part 13 vertically extends from the inner surface 11*a* of the top plate part 11 in a space surrounded by the side wall part 12, and is a hollow cylinder member having an open leading end. An axis center $O_2$ of the inner cylinder part 13 is aligned with a center $O_1$ of the top plate part 11. The side wall part 12 and the inner cylinder part 13 are coaxially positioned. An annular space 17 is formed between an outer circumferential surface 13*a* of the inner cylinder part 13 and the inner circumferential surface 12*a* of the side wall part 12. The annular space 17 is a space having a circular inner circumference surface and a circular outer circumference surface. The inner ring 16*a*, the contact ring 16*b*, and the auxiliary ring 16*c* are formed between the side wall part 12 and the inner cylinder part 13, and project into the annular space 17. As illustrated in FIG. 2, an open end part 13*b* of the inner cylinder part 13 and an open end part 12*d* of the side wall part 12 are located in the same plane. Namely, the position of the open end part 13*b* of the inner cylinder part 13 in the axial direction coincides with the position of the open end part 12*d* of the side wall part 12 in the axial direction.

The projection parts 14 include a plurality of solid cylindrical members each of which projects from an outer surface 11*b* of the top plate part 11 to expose outside when the bottle cap 1 is attached to the bottle 2. In this embodiment, four projection parts 14 are formed in the outer surface 11*b* of the top plate part 11. A diameter $R_1$ of each projection part 14 has the same dimension as a width $R_2$ of the annular space 17 in the radial direction. A projection dimension (length) $L_1$ of each projection part 14 from the top plate part 11 is smaller than a distance $L_2$ from the open end part 12*d* of the side wall part 12 to the lower end part of the female thread part 12*b* in the axial direction. A projection position of each of the four projection parts 14 overlaps with the set position of the annular space 17 formed between the side wall part 12 and the inner cylinder part 13. Namely, as illustrated in FIG. 4, each of the projection parts 14 overlaps with the circular space 17 in plan view. Each of the four projection parts 14 is provided in a position closest to a respective one of the corner parts 15*a* of the external wall part 15. Namely, as illustrated in FIG. 4, an axial center $O_3$ of each projection part 14 is set on a respective straight line $L_A$ to $L_D$ connecting the center $O_1$ of the top plate part 11 and diagonally opposite corner parts 15*a* of the external wall part 15. A concave part 14*a* is formed in the leading end of each projection part 14.

The external wall part 15 is a square tube member having the four corner parts 15*a*. The external wall part 15 surrounds the entire circumference of the side wall part 12, and the four parts of an inside surface 15*b* contact the outer circumference surface 12*c* of the side wall part 12. The position of the first end part of the external wall part 15 in the axial direction coincides with the top plate part 11, while the position of the second (opposite) end part of the external wall part 15 in the axial direction coincides with the position of the open end part 12*d* of the side wall part 12 in the axis direction. A through-space 18 that is surrounded by the corner part 15*a* of the external wall part 15 and the side wall part 12, and includes open both ends in the axial direction is provided between the external wall part 15 and the side wall part 12.

The tamper-evident band 20 is a hollow cylindrical member that extends from the leading end part of the side wall part 12 and includes an open leading end. The diameter of the tamper-evident band 20 gradually increases toward the leading end. A locking part 21 folded back toward the top plate part 11 is formed inside the tamper-evident band 20.

A plurality of locking parts 21 is formed at certain intervals along the circumferential direction of the tamper-evident band 20. Each locking part 21 has an approximately rectangular shape in a plan view, and elastically deforms in the inside and outside direction of the radial direction. The tamper-evident band 20 is located between the upper flange part 4 and the lower flange part 5 when the bottle cap 1 is attached to the bottle mouth 2A. Upon opening, the locking part 21 interferes with the upper flange part 4 to prevent the movement of the tamper-evident band 20.

The fragile part 30 is formed in the border of the side wall part 12 and the tamper-evident band 20. The side wall part 12 and the tamper-evident band 20 are connected through the fragile part 30. A plurality of fragile parts 30 is formed, and the fragile parts are arranged side by side at certain intervals along the circumferential direction.

Next, a bottle opening and closing effect and a toy block effect as the operations of the bottle cap of Embodiment 1 will be described.

[Bottle Opening and Closing Effect]

Figure 5:
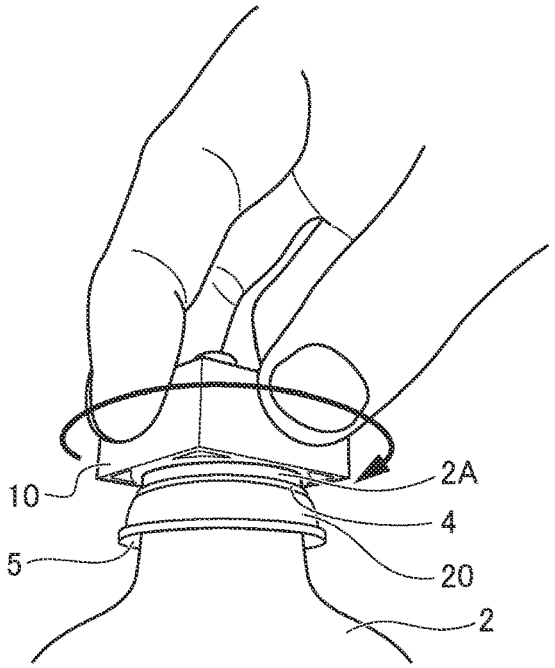
FIG. 5 is an explanation view illustrating an operation of detaching the bottle cap of Embodiment 1 from the bottle.

FIG. 5 is an explanation view illustrating an operation of detaching the bottle cap of Embodiment 1 from the bottle. The bottle opening and closing effect in the bottle cap of Embodiment 1 will be described with reference to FIGS. 1 to 5.

When the bottle 2 is closed by the bottle cap 1 of Embodiment 1, the bottle mouth 2A of the bottle 2 filled with water, for example, is covered by the bottle cap 1. Next, by rotating the cap main body 10 in the close direction, the bottle cap 1 is inserted into the bottle mouth 2A by the screwing operation of the male thread part 3*b* and the female thread part 12*b*. Since the tamper-evident band 20 has a diameter larger than that of the side wall part 12, the tamper-evident band 20 does not interfere with the male thread part 3*b* and the upper flange part 4. The locking part 21 moves over the male thread part 3*b* and the upper flange part 4 while elastically deforming in the folding direction. The locking part 21 elastically returns to the original shape after moving over the upper flange part 4, and fits below the upper flange part 4. The inner ring 16*a* is inserted into the bottle mouth 2A to closely contact the inside surface of the bottle mouth 2A. The contact ring 16*b* is pressed to the end surface of the opening 3*a* of the bottle mouth 2A, and the auxiliary ring 16*c* closely contacts the outside surface of the bottle mouth 2A. The bottle cap 1 is thereby completely attached (the bottle closing operation).

When the bottle cap 1 of Embodiment 1 is opened, as illustrated in FIG. 5, the cap main body 10 is gripped to be rotated in the open direction. The bottle cap 1 is thereby detached from the bottle mouth 2A by the screwing operation of the male screw part 3*b* and the female screw part 12*b*. Since the locking part 21 interferes with the upper flange part 4, the tamper-evident band 20 does not move over the upper flange part 4. By further rotating the cap main body 10, a plurality of fragile parts 30 is gradually stretched by the movement of the cap main body 10, and the fragile parts 30 are broken when the cap main body 10 is detached a certain amount. The cap main body 10 is thereby separated from the tamper-evident band 20, and the bottle cap 1 is completely detached (the bottle opening operation).

In the bottle cap 1 of Embodiment 1, the square tube external wall part 15 surrounds the circumference of the hollow cylinder side wall part 12. The cap main body 10 has a cuboid (cube-shaped) external appearance. Such a cuboid cap main body 10 has a higher finger hooking performance during the rotation of the cap main body 10 than that of a cylindrical cap main body. More specifically, the cap main body 10 is rotated by hooking tips of fingers on the corner part 15*a* of the external wall part 15, so that the bottle opening operation is easily performed.

[Block Toy Effect]

FIGS. 6A to 10B are views illustrating the connection of the bottle caps of Embodiment 1. Hereinafter, the toy block effect of the bottle cap of Embodiment 1 will be described with reference to FIGS. 6A to 10B.

The bottle cap 1 of Embodiment 1 is detached from the bottle 2 to separate the cap main body 10 and the tamper-evident band 20. After that, this cap main body 10 can be stacked on the cap main body 10 of another bottle cap 1 in the axial direction so as to be connected. The bottle caps 1 are therefore used as toy blocks.

Figure 6A:
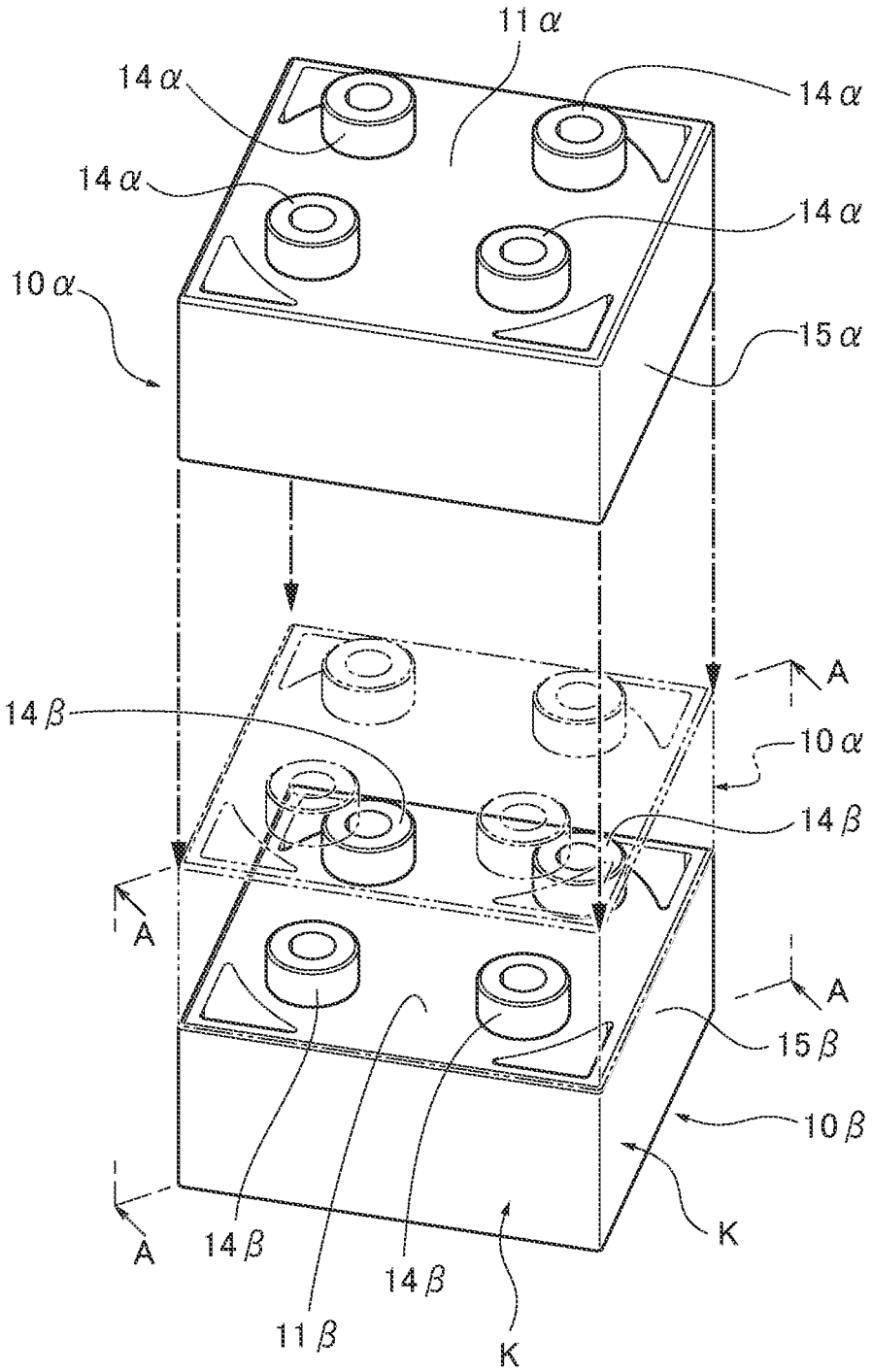
FIG. 6A is a perspective view illustrating a connection of the bottle caps of Embodiment 1.

More specifically, the diameter $R_1$ of each of the projection parts 14 projecting from the outer surface 11*b* of the top plate part 11 has the same dimension as the width $R_2$ of the annular space 17 in the radial direction formed inside the cap main body 10, and the projection position of each of the projection parts 14 overlaps with the set position of the annular space 17. As illustrated in FIG. 6A, when a first cap main body 10α is stacked on a second cap main body 10β in the axial direction, second projection parts 14β are inserted into a first circular space 17α, and the second projection parts 14β are held by a side wall part 12α and an inner cylinder part 13α of the first cap main body 10α (see FIG. 6C). The first cap main body 10α and the second cap main body 10β are thereby connected.

Figure 6B:
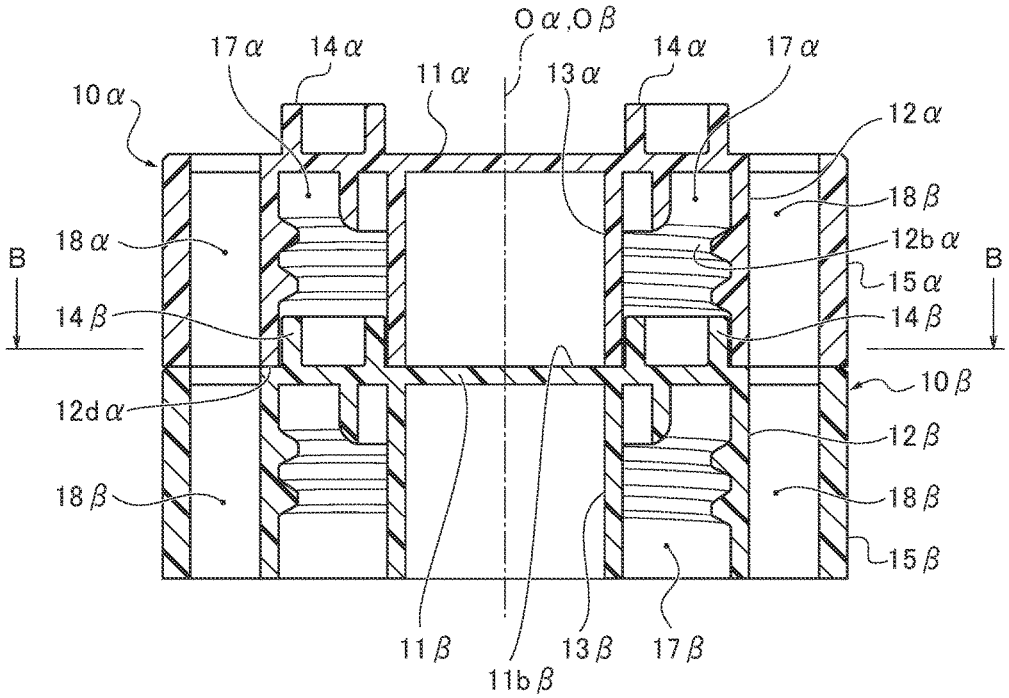
FIG. 6B is a sectional view on an A-plane in FIG. 6A.
Figure 6C:
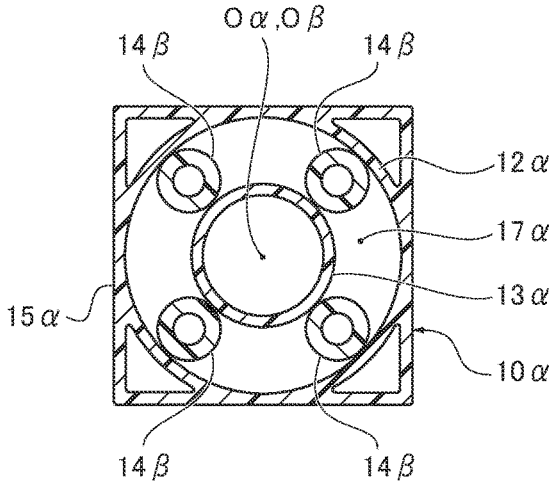
FIG. 6C is a B-B sectional view in FIG. 6B.

In this case, by inserting all of a plurality of projection parts 14β of the second cap main body 10β into the annular space 17α of the first cap main body 10α, the axial center Oα of the first cap main body 10α is aligned with the axial center Oβ of the second cap main body 10β, as illustrated in FIG. 6B. The external wall part 15α of the first cap main body 10α is also aligned with the external wall part 15β of the second cap main body 10β. The vertically disposed four walls K are thereby formed (see FIG. 6A).

In the cap main body 10 of Embodiment 1, the outside of the side wall part 12 is surrounded by the square tube external wall part 15 including the inside surface 15*b* that contacts the outer circumference surface 12*c* of the side wall part 12. As illustrated in FIG. 1, for example, the cap main body 10 therefore has a cuboid external appearance. Adjacent cap main bodies are thus connected without a space, and the creativity as the toy block is improved.

Figure 7A:
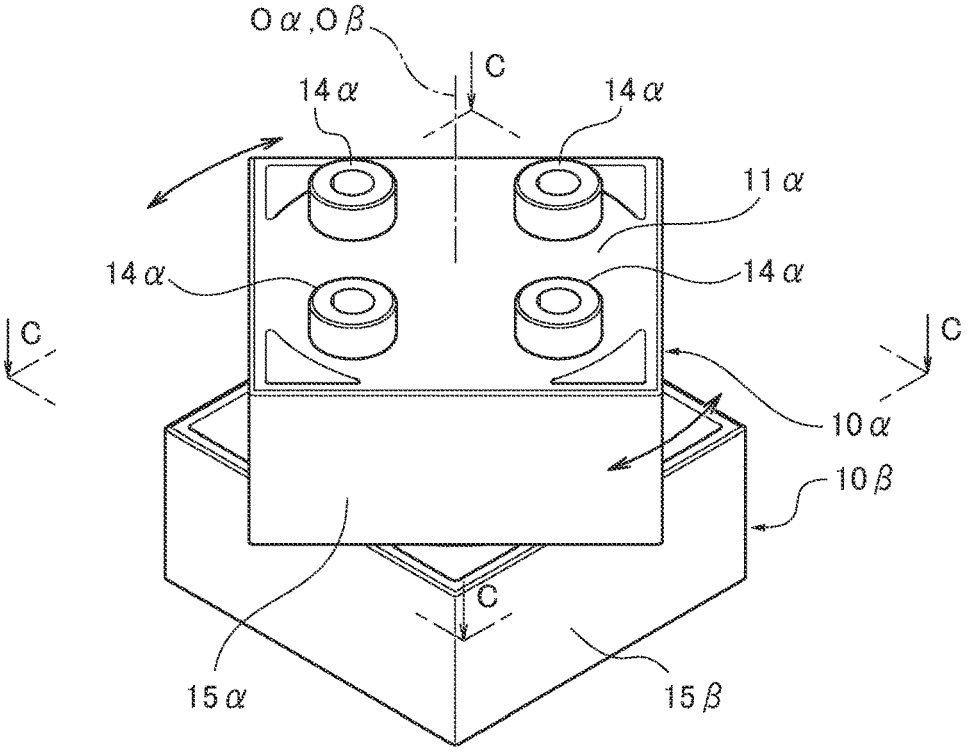
FIG. 7A is a perspective view showing the connected bottle caps in Embodiment 1 are twisted.
Figure 7B:
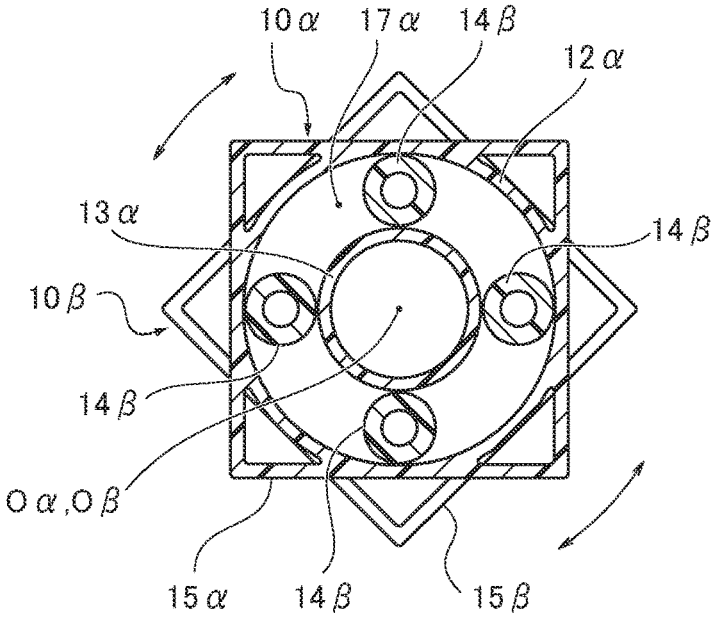
FIG. 7B is a sectional view on a C-plane in FIG. 7A.

In the bottle cap 1 of Embodiment 1, the cylindrical projection parts 14β are inserted into the annular space 17*a* including the circular inner circumferential surface and the circular outer circumferential surface. As illustrated in FIG. 7A, the first cap main body 10α and the second cap main body 10β which are connected to each other are therefore relatively rotated about the axis centers Oα, Oβ. More specifically, as illustrated in FIG. 7B, when the first and second cap main bodies 10α, 10β are relatively rotated about the axis centers Oα, Oβ, the projection parts 14β move along the annular space 17α without interfering with the inside surface of the annular space 17α. The two cap main bodies 10α, 10β which are connected to each other are therefore twisted.

Figure 8A:
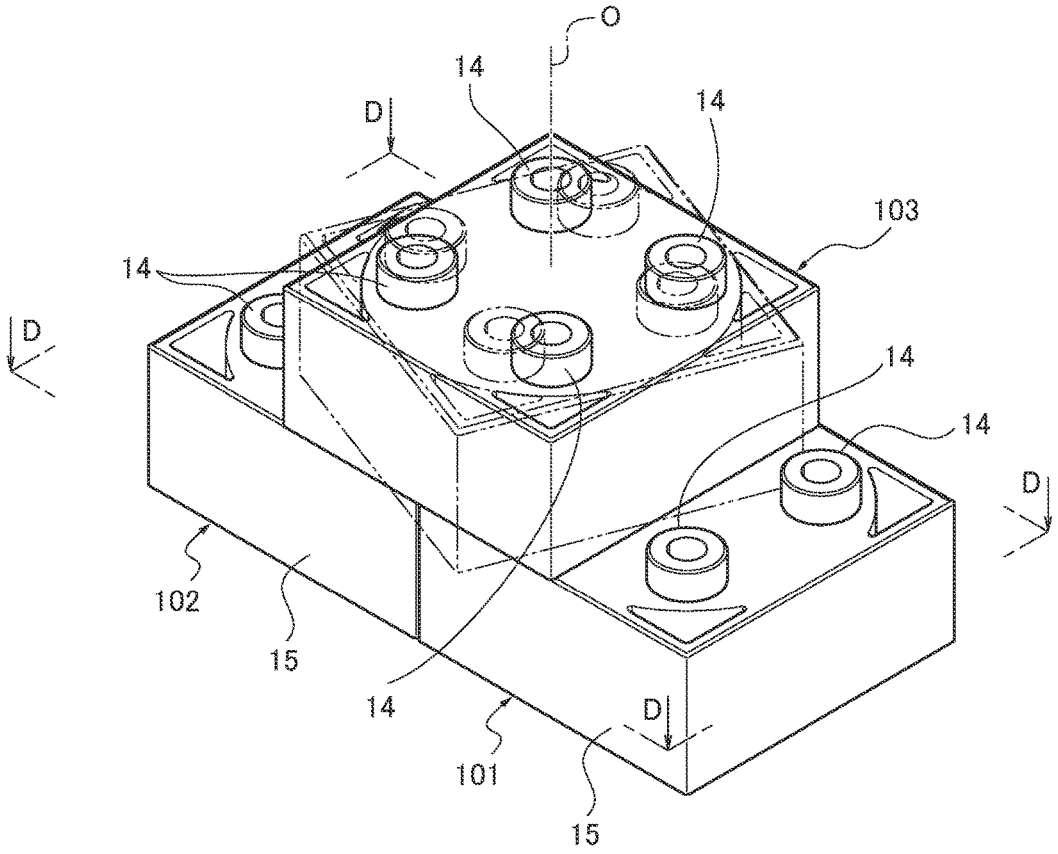
FIG. 8A is a perspective view illustrating a first modified example of the connection of the bottle caps in Embodiment 1.
Figure 8B:
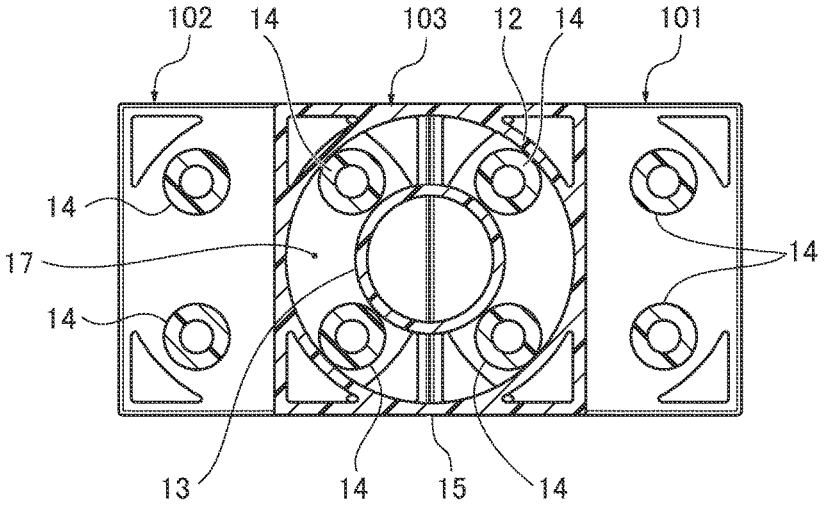
FIG. 8B is a sectional view on a D-plane in FIG. 8A.
Figure 9A:
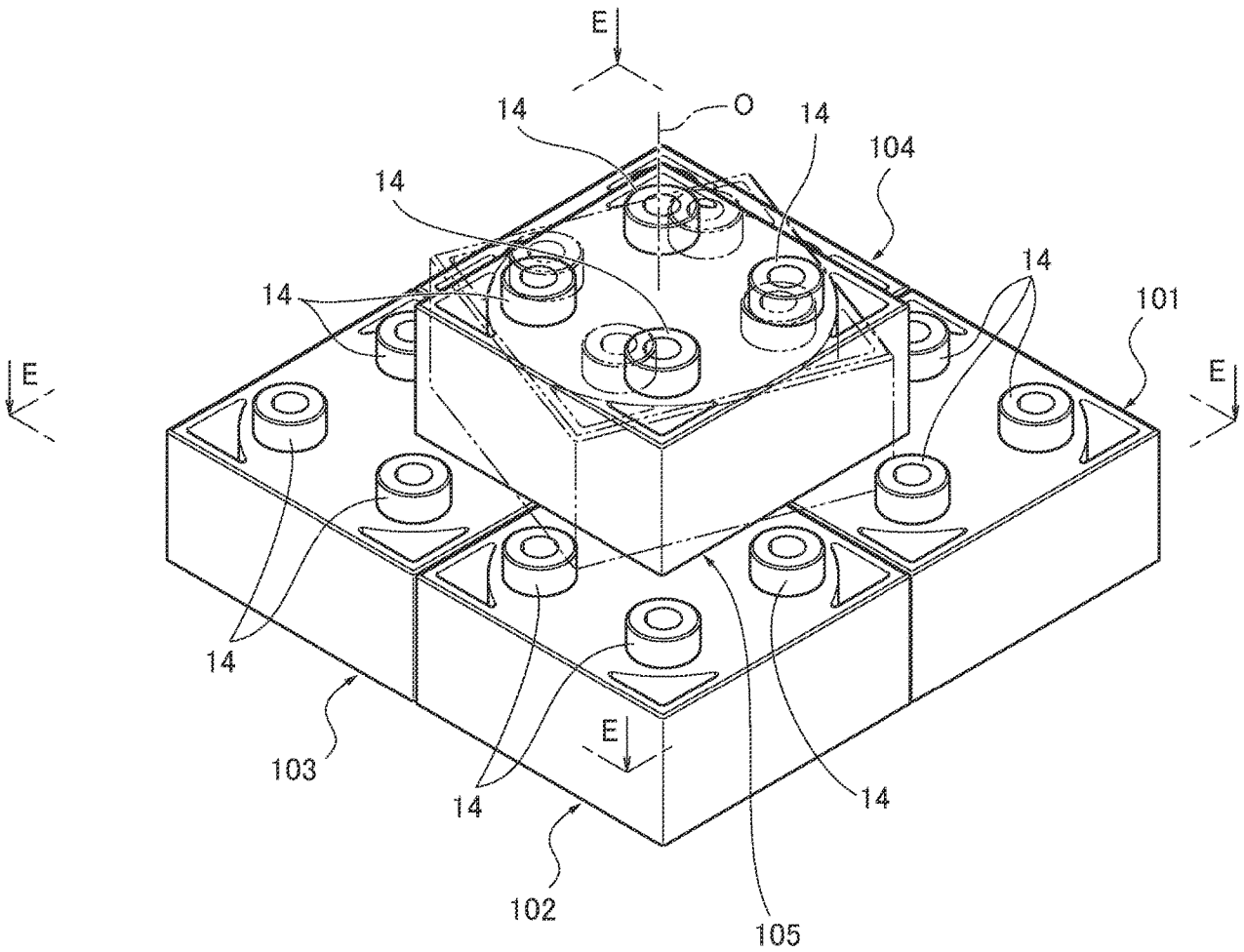
FIG. 9A is a perspective view illustrating a second modified example of the connection of the bottle caps in Embodiment 1.
Figure 9B:
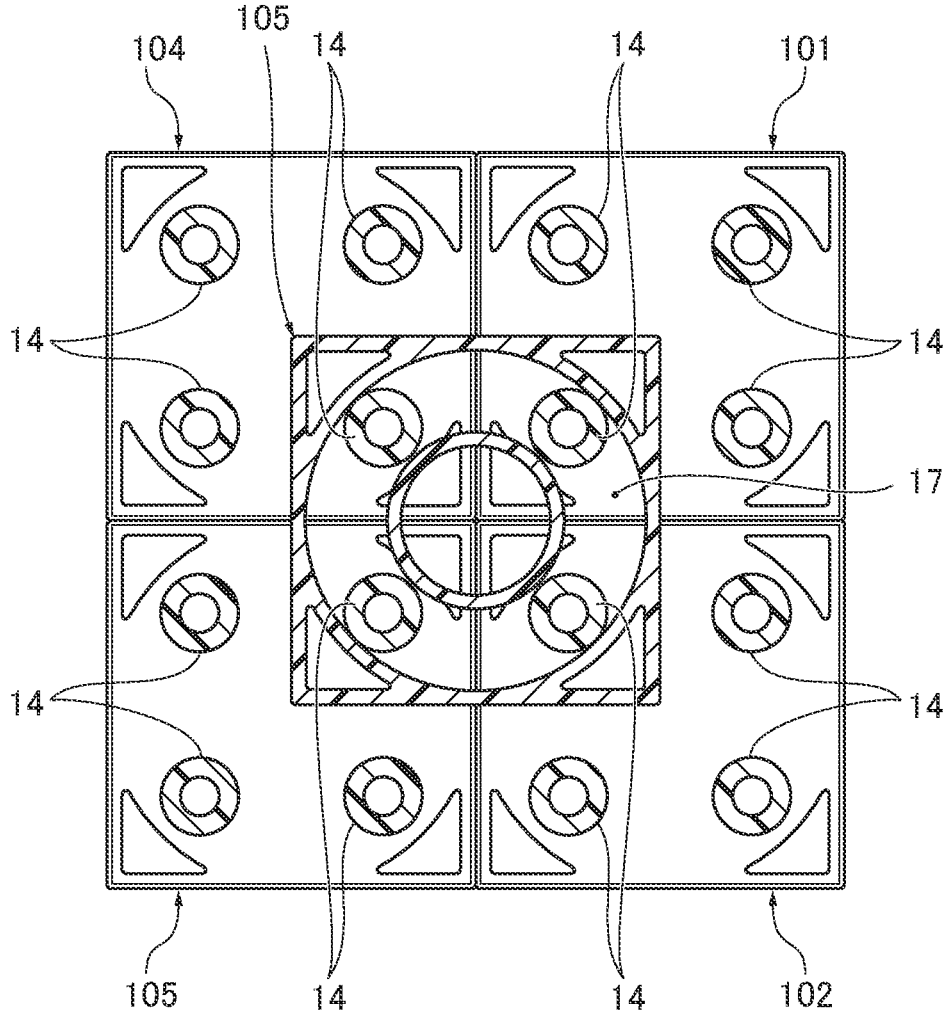
FIG. 9B is a sectional view on an E-plane in FIG. 9A.

In the bottle cap 1 of Embodiment 1, even though the axis center Oα of the cap main body 10α is not aligned with the axis center Oβ of the cap main body 10β, the two cap main bodies 10α, 10β are connected as long as at least one of the projection parts 14β is inserted into the circular space 17α. In Embodiment 1, the four projection parts 14 are formed, and these projection parts 14 are each provided in positions closest to a respective one of the corner parts 15*a* of the external wall part 15. With this, a third cap main body 103 is connected to each of the two cap main bodies 101, 102 which are arranged side by side in the horizontal direction such that the external wall parts 15 contact each other, as illustrated in FIGS. 8A, 8B. The three cap main bodies 101, 102, 103 are thereby integrally connected. Moreover, as illustrated in FIGS. 9A, 9B, a fifth cap main body 105 is connected to each of the four cap main bodies 101, 102, 103, 104 which are arranged side by side in the horizontal direction such that the external wall parts 15 contact each other. The five cap main bodies 101, 102, 103, 104, 105 are thereby integrally connected.

More specifically, the half of another cap main body 10 may be stacked on the cap main body 10 such that another cap main body 10 is connected to the cap main body 10, and a quarter of another cap main body 10 may be stacked on the cap main body 10 such that another cap main body is connected to the cap main body 10.

Figure 10A:
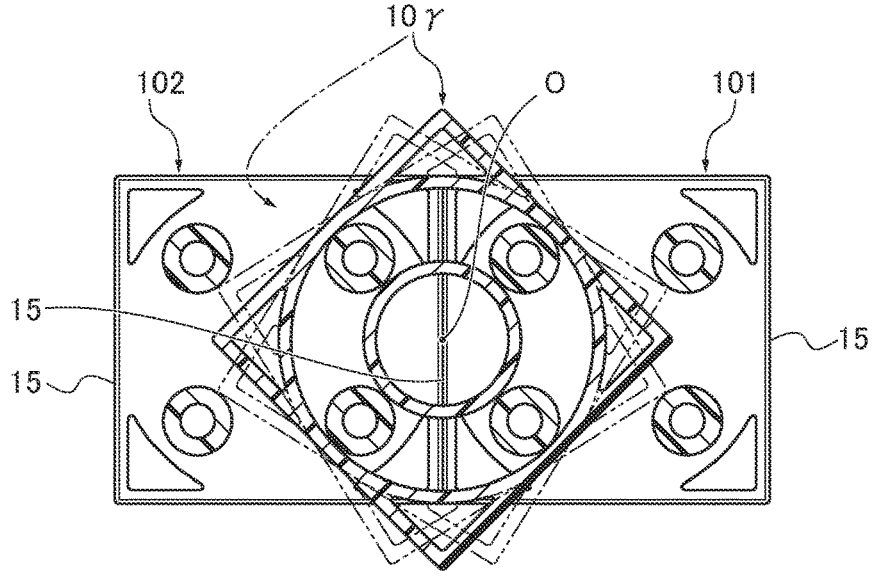
FIG. 10A is a sectional view in a third modified example of the connection of the bottle caps in Embodiment 1.
Figure 10B:
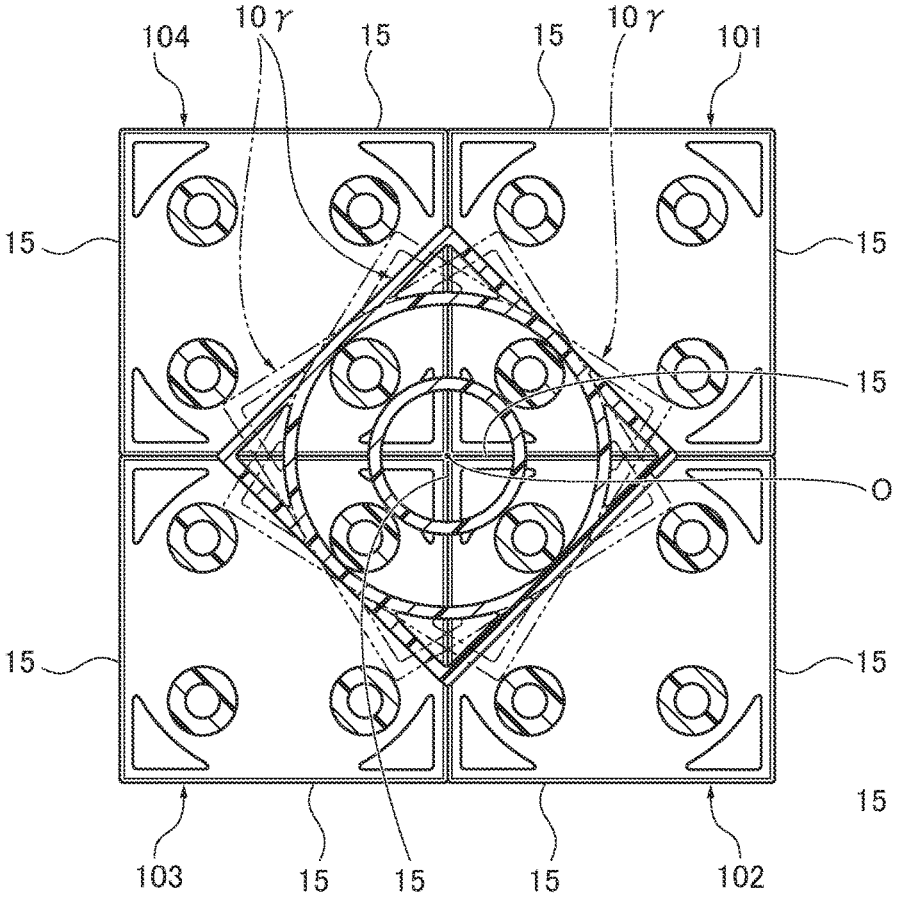
FIG. 10B is a sectional view in a fourth modified example of the bottle caps in Embodiment 1.

As illustrated in FIGS. 10A, 10B, when another cap main body 10γ is stacked on a plurality of cap main bodies 101, 102 arranged side by side in the horizontal direction, these cap main bodies are connected such that the extending directions of the external wall parts 15 of the lower cap main bodies 101, 102 are aligned with the diagonal line direction of the upper cap main body 10γ.

Even though the axis centers O of the cap main bodies 10 connected in the up and down direction are not aligned, the upper cap main body 10 can rotate about the axis center O with the cap main bodies being connected in the up and down direction, as illustrated by the broken lines in FIGS. 8A, 9A, 10A, and 10B. In this case, the upper cap main body 10 is rotatable as long as the projection part 14 of the lower cap main body 10 does not interfere with the corner part 15*a* of the upper cap main body 10.

As described above, in the bottle cap 1 of Embodiment 1, even though the axis centers O are not aligned, the bottle caps can be connected without increasing the number of projection parts 14. The shape of the projection part 14 is thus simplified, and the accuracy required for manufacturing the bottle cap is controlled. Since many projection parts 14 are not required, a sufficient space between the projection parts 14 is maintained. For example, dust adhered between the projection parts 14 is therefore easily cleaned up.

In the bottle cap 1 of Embodiment 1, the open end part 13*b* of the inner cylinder part 13 and the open end part 12*d* of the side wall part 12 are located on the same plane, and the position of the open end part 13*b* of the inner cylinder part 13 in the axis direction coincides with the position of the open end part 12*d* of the side wall part 12 in the axis direction. When the first cap main body 10α and the second cap main body 10β are connected in the axis direction, as illustrated in FIG. 6B, an open end part 12*d*α of the side wall part 12α of the first cap main body 10α contacts an outer plane llbβ of the top plate part 11β of the second cap main body 10β without a space. On the other hand, the projection parts 14β formed in the second cap main body 10β are inserted in the annular space 17α of the first cap main body 10α over the entire length. As a result, the quality of the external appearance when the two cap main bodies 10α, 10β are connected is improved, and sufficient connection force of the cap main bodies which hardly disconnect the cap main bodies is obtained.

In Embodiment 1, the projection dimension $L_1$ of each projection part 14 from the top plate part 11 is smaller than the distance $L_2$ from the open end part 12*d* of the side wall part 12 to the lower end of the female screw part 12*b* in the axis direction. With this, when the projection part 14β formed in the second cap main body 10 is inserted into the annular space 17α of the first cap main body 10α, the female screw part 12*b*α formed in the first cap main body 10α does not interfere with the projection part 14β. The female screw part 12*b*α is therefore prevented from being deformed, and the attachment performance of the first cap main body 10α on the bottle 2 is also prevented from being deteriorated.

In Embodiment 1, the position of one end part of the external wall part 15 in the axis direction coincides with the top plate part 11 while the position of the other end part of the external wall part 15 in the axis direction coincides with the position of the open end part 12*d* of the side wall part 12 in the axis direction. The external wall parts 15 located in the up and down direction therefore contact each other without a space therebetween, and the external appearance quality, i.e., appearance when the two cap main bodies 10α, 10β are connected is also improved.

In the bottle cap 1 of Embodiment 1, a through-space 18 including open both end parts in the axis direction is provided between the side wall part 12 and the corner part 15*a* of the external wall part 15. With this, the cap main body 10, the tamper-evident band 20, and the fragile part 30 are integrally molded by resin. Even if an infant swallows the cap main body 10 by accident, air flows via the through-space 18.

In the bottle cap of Embodiment 1, the concave part 14*a* is formed in the leading end of the projection part 14. A sink mark due to the molding of the resin bottle cap 1 is thereby controlled, and the deformation of the projection part 14 is also controlled. The two cap main bodies 10 are thereby reliably connected without the deformation of the projection part 14 when the two cap main bodies 10 are connected.

In the bottle cap 1 of Embodiment 1, the inner ring 16*a* that contacts the inside of the bottle mouth 2A of the bottle 2 is integrally formed in the inner surface 11*a* of the top plate part 11. With this, while the bottle cap 1 is attached to the bottle 2, the leakage of the content in the bottle 2 can be prevented. It becomes therefore unnecessary to form a packing which prevents the leakage of the content in the bottle 2 with another member. A so-called one-piece cap is thereby obtained. In Embodiment 1, the auxiliary ring 16*c* that closely contacts the outside of the bottle mouth 2A and the contact ring 16*b* that is pressed to the end part of the opening 3*a* of the bottle mouth 2A are formed. With this, the sealing performance by the bottle cap 1 is thereby improved, and a higher prevention performance of the leakage of the content than that of a bottle cap provided only with the inner ring 16*a* is obtained.

Next, the effects will be described. The following effects are achieved by the bottle cap 1 in Embodiment 1.

(1) The bottle cap 1 that is detachably attached to the bottle mouth 2A of the bottle 2 includes the top plate part 11 that covers the opening 3*a* of the bottle mouth 2A, the side wall part 12 of the hollow cylinder that vertically extends from the rim of the top plate part 11 and is screwed to the bottle mouth 2A, the inner cylinder part 13 of the hollow cylinder that vertically extends in a space surrounded by the side wall part 12 from the inner surface 11*a* of the top plate part 11 and forms the circular space 17 with the side wall part 12, and a plurality of cylinder projection parts 14 that project from the outer surface 11*b* of the top plate part 11 and have the diameter $R_1$ having the same dimension as the width $R_2$ of the annular space 17 in the radial direction. The projection position of the projection part 14 overlaps with the set position of the annular space 17. With this configuration, the bottle caps 1 are capable of being connected to other bottle caps stacked in the axial direction with a simple structure.

(2) The bottle cap further includes the external wall part 15 of the square tube that surrounds the outside of the side wall part 12 and includes the inside surface 15*b* that contacts the outer circumference surface 12*c* of the side wall part 12. With this configuration, in addition to the effect (1), the opening operation of the bottle cap 1 is easily performed, and the creativity as the toy block is also improved.

(3) The through-space 18 including both open end parts in the axial direction is provided between the side wall part 12 and the external wall part 15. With this configuration, in addition to the effect (2), the bottle cap 1 is integrally molded by resin, and it becomes possible for air to flow through the bottle cap 1 in the case of accidentally swallowing.

(4) Each projection part 14 is provided in a position closest to a respective one of the corner parts 15*a* of the external wall part 15. With this configuration, in addition to the effects (1) to (3), another cap main body 10 may be connected to the cap main body 10 such that the half of the other cap main body 10 is stacked on the cap main body 10. Another cap main body 10 may be connected to the cap main body 100 such that the quarter of the other cap main body is stacked on the cap main body. The cap main bodies are thereby connected in various ways.

(5) The projection part 14 includes, at a leading end thereof, a concave part 14*a*. With this configuration, in addition to the effects (1) to (4), the sink and the deformation of the projection part 14 are controlled, and deterioration in connection accuracy is also prevented.

(6) The inner ring 16*a* that contacts the inside of the bottle mouth 2A is integrally formed in the inner surface 11*a* of the top plate part 11. With this configuration, in addition to the effects (1) to (5), it becomes unnecessary to have a separate packing which prevents the leakage of the content in the bottle 2. One-piece cap is therefore obtained.

(7) The open end part 12*d* of the side wall part 12 and the open end part 13*b* of the inner cylinder part 13 are located on the same plane. With this configuration, in addition to the effects (1) to (6), the two cap main bodies 10α, 10β are connected without a space. The external appearance quality in the connection is improved, and sufficient connection force which hardly disconnects the cap main bodies is also obtained.

Although the bottle cap of the present invention has been described based on Embodiment 1, the present invention is not limited thereto. It should be appreciated that variations may be included in the present invention without departing from the scope of the present invention.

Figure 11A:
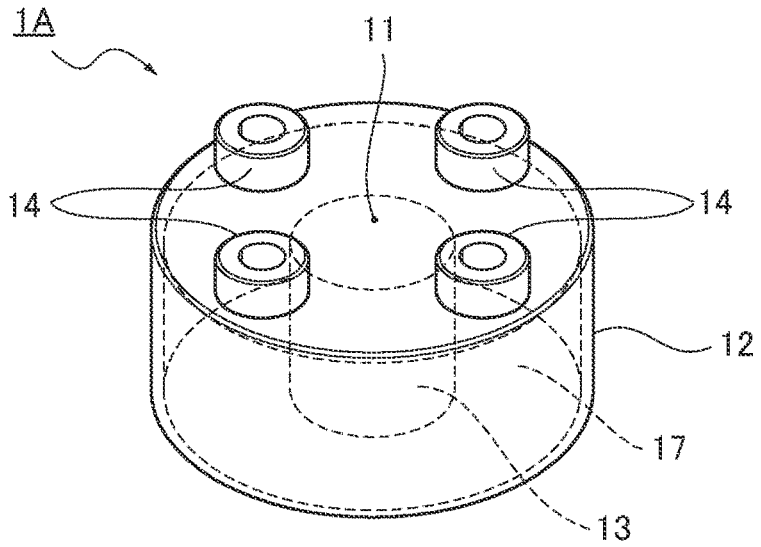
FIG. 11A is a perspective view illustrating a first modified example of the bottle cap of Embodiment 1.

Embodiment 1 shows the example of the bottle cap in which the outside of the side wall part 12 is surrounded by the square tube external wall part 15. However, the bottle cap is not limited thereto. For example, as a bottle cap 1A illustrated in FIG. 11A, the side wall part 12 may be exposed outside without providing the external wall part 15 such that the cap main body 10 has a cylindrical external appearance.

Figure 11B:
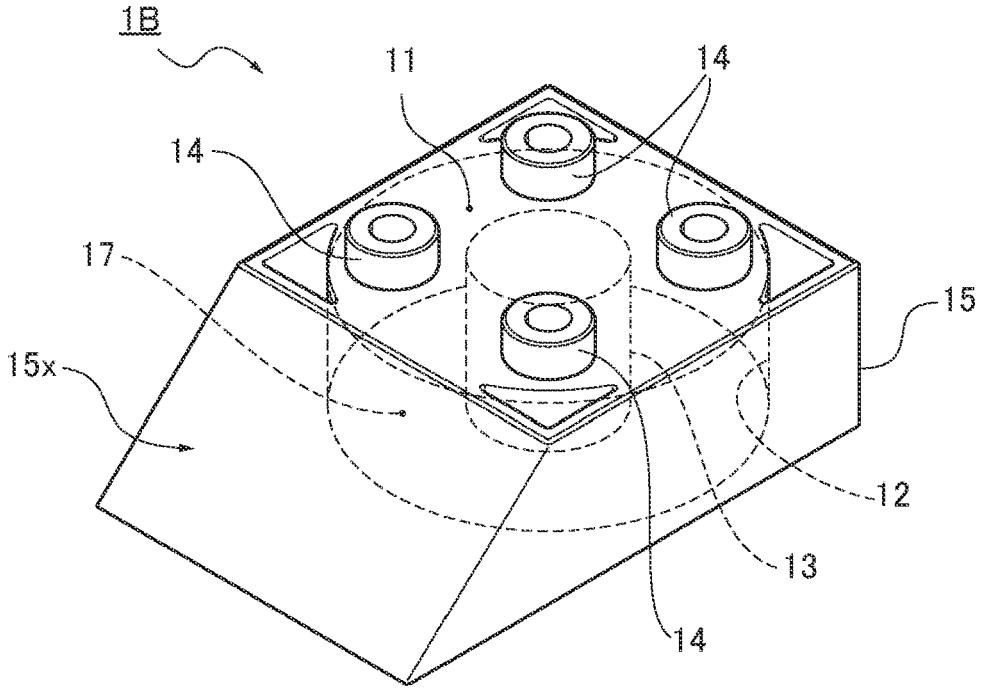
FIG. 11B is a perspective view illustrating a second modified example of the bottle cap of Embodiment 1.

Moreover, as a bottle cap 1B illustrated in FIG. 11B, one surface 15*x* of the external wall part 15 may be inclined. Even in this case, as the side wall part 12 and the inner cylinder part 13 have the cylinder shape, the annular space 17 is formed. Furthermore, the external wall part 15 may have a triangle tube shape including three surfaces, or a polygonal tube shape including five or more surfaces. The external appearance of the cap main body 10 is thereby diversified, and the creativity as the toy block is thus improved.

Embodiment 1 shows the example of the bottle cap in which the four projection parts 14 are formed. However, the bottle cap is not limited thereto. The number of projection parts is freely set, and it is not always necessary to form the concave part 14*a* in the leading end of each projection part 14.

Embodiment 1 shows the example of the bottle cap in which the through-space 18 having the open both ends in the axis direction is formed between the side wall part 12 and the external wall part 15. However, the bottle cap is not limited thereto. The cap main body 10, the tamper-evident band 20, and the fragile part 30 are integrally molded by resin even though the end part of the through-space 18 on the tamper-evident band 20 is closed. When the cap main body 10, the tamper-evident band 20, and the fragile part 30 are not integrally molded by resin, it is not necessary to provide the through-space 18. In this case, the top plate part 11 can be expanded to the region surrounded by the external wall part 15.

The invention claimed is:

1. A bottle cap to be detachably attached to a bottle mouth of a bottle, said bottle cap comprising:

a top plate part configured to cover an opening of the bottle mouth;

a side wall part having a hollow cylindrical shape, said side wall part vertically extending from a rim of said top plate part to be screwed to the bottle mouth;

an inner cylindrical part having a hollow cylindrical shape, said inner cylindrical part vertically extending from an inner surface of said top plate part into a space surrounded by said side wall part, said side wall part and said inner cylindrical part being coaxially arranged to form an annular space therebetween;

four cylindrical projection parts projecting from an outer surface of said top plate part, each of said cylindrical projection parts having a diameter equal to a radial width of said annular space; and an external wall part having a square tubular shape surrounding an outside of said side wall part, said external wall part having an inside surface contacting an outer circumferential surface of said side wall part, and having four right-angled corners, wherein a projection position of each of said four projection parts overlaps with a position of said annular space in plan view, and an axial center of each of said four projection parts is located on one of a pair of virtual straight lines extending through an axial center of said top plate part and diametrically opposite pairs of said four right-angled corners.

2. The bottle cap according to claim 1, wherein said top plate part, said side wall part, and said external wall part are configured to form a through-space having both axial ends open, said through-space being located between said side wall part and said external wall part.

3. The bottle cap according to claim 2, wherein said through-space is one of four through-spaces located between said side wall part and said external wall part, each of said through-spaces having both axial ends open and being located at a respective one of said four right-angled corners.

4. The bottle cap according to claim 1, wherein each of said projection parts has a concave part at a top end thereof.

5. The bottle cap according to claim 1, further comprising an inner ring for contacting an inside surface of the bottle mouth, said inner ring being integrally formed on said inner surface of said top plate part.

6. The bottle cap according to claim 5, wherein an open end of said side wall part and an open end of said inner cylinder part are located on a same virtual plane.

7. The bottle cap according to claim 1, wherein an open end of said side wall part and an open end of said inner cylinder part are located on a same virtual plane.

* * * * *